US008272885B2

(12) United States Patent
Pearce et al.

(10) Patent No.: US 8,272,885 B2
(45) Date of Patent: Sep. 25, 2012

(54) CONNECTOR

(75) Inventors: Oliver Pearce, Boroughbridge (GB); Eric Chaize, North Yorkshire (GB)

(73) Assignee: RMSpumptools Limited, Aberdeen (GB)

( * ) Notice: Subject to any disclaimer, the term of this patent is extended or adjusted under 35 U.S.C. 154(b) by 0 days.

(21) Appl. No.: 13/104,434

(22) Filed: May 10, 2011

(65) Prior Publication Data

US 2011/0306227 A1 Dec. 15, 2011

(30) Foreign Application Priority Data

May 11, 2010 (GB) ..... 1007841.8
Jan. 19, 2011 (GB) ..... 1100909.9
Jan. 19, 2011 (GB) ..... 1100910.7
Mar. 16, 2011 (GB) ..... 1104408.8

(51) Int. Cl.
*H01R 13/625* (2006.01)

(52) U.S. Cl. ..... 439/345

(58) Field of Classification Search ..... 439/345, 439/271, 598, 575, 217
See application file for complete search history.

(56) References Cited

U.S. PATENT DOCUMENTS 4,039,242 A 8/1977 Wilson et al.
4,373,767 A * 2/1983 Cairns ..... 439/275
4,500,156 A * 2/1985 Nguyen ..... 439/275
6,152,769 A * 11/2000 Gimenes et al. ..... 439/598
6,511,335 B1 * 1/2003 Rayssiguier et al. ..... 439/191

FOREIGN PATENT DOCUMENTS

GB 2366673 A 3/2002
GB 2402560 A 12/2004

OTHER PUBLICATIONS

Search Report of GB1100909.9; May 6, 2011; 1 pg.
Search Report of GB1100910.7; May 6, 2011; 1 pg.
Search Report of GB1104408.8; Mar. 25, 2011; 1 pg.

* cited by examiner

*Primary Examiner* — Jean F Duverne
(74) *Attorney, Agent, or Firm* — Gardner Groff Greenwald & Villanueva, PC

(57) ABSTRACT

There is disclosed a connector, such as a wet-mateable connector, comprising first and second components having first and second contacts respectively and arranged to be coupled together such that the first and second contacts make a connection. The connector comprises a shuttle associated with the first component and moveable between at least a decoupled position in which the shuttle protects the first contact and a coupled position in which the first contact is exposed. During coupling of the first and second components the shuttle is moved to the coupled position so as to expose the first contact such that it can make an electrical connection with the second contact. The connector also comprises a latch arranged to latch the second component to the shuttle such that upon decoupling of the first and second components, the shuttle is returned to the decoupled position.

23 Claims, 9 Drawing Sheets

CONNECTOR

CROSS-REFERENCE TO RELATED APPLICATIONS

This application claims priority to British Patent Application No. 1007841.8 filed on 11 May 2010, British Patent Application No. 1100910.7 filed on 19 Jan. 2011, British Patent Application No. 1100909.9 filed on 19 Jan. 2011, and British Patent Application No. 1104408.8 filed on 16 Mar. 2011, which are incorporated herein by reference in their entireties.

BACKGROUND OF THE INVENTION

The invention relates to a connector having first and second components arranged to be coupled together, in particular, although not exclusively, to a connector for making a connection underwater having male and female components arranged to be coupled together. Such connectors are sometimes known as a "wet-mate" or "wet-mateable" connectors.

Wet-mate connectors are used in underwater applications where it is necessary to make a connection, such as an electrical or optical connection, in an environment which is hostile to contact, for example in sea water. Special protection is therefore required for the components that complete the connection.

One example of an application in which an electrical connection must be made in a harsh underwater environment is that of a well-head in a sub-sea oil well.

After assembly of the well-head on the sea bed it is necessary to connect control cables to sensors and other electrical equipment associated with the well-head. The two connectable parts typically comprise a female component and a male component; each having an electrical contact. The electrical contact may be provided with a protective apparatus to shield it in order to preserve the integrity of the connector and therefore the electrical connection when subsequently made.

A moveable shuttle may be used to protect one or more electrical contacts. The shuttle may be moveable between an unconnected configuration in which it protects one of the electrical contacts and a connected position in which the contact is exposed.

In one previously considered arrangement, a shuttle is provided to protect the electrical contact of the female component. The shuttle is resiliently biased to the unconnected configuration by a spring arrangement. When the male component is inserted into the female component, the male component axially moves the shuttle against the spring until electrical connection is made between the male and female contacts. When the male component is withdrawn from the female component, the shuttle is returned to the unconnected position by the spring.

As well-head connections become more complex with increasing requirements for monitoring and control equipment, the space available for connectors of the kind described above becomes reduced, and thus the need for more compact connectors increases.

SUMMARY OF THE INVENTION

Embodiments of the invention aim to provide a connector which is compact and reliable and which provides improved protection for the electrical contacts therein.

In a broad aspect the invention concerns a latch arranged to latch a connector component to a shuttle which is moveable between a first (decoupled) position in which it protects a contact and a second (coupled) position in which the contact is exposed. The latch allows the shuttle to be returned to the first position by moving the connector component.

According to an aspect of the invention there is provided a connector, comprising: first and second components having first and second contacts respectively and arranged to be coupled together such that the first and second contacts make a connection; a shuttle associated (or coupled) with the first component and moveable (with respect to the first component) between at least a decoupled position in which the shuttle protects the first contact and a coupled position in which the first contact is exposed, wherein during coupling of the first and second components the shuttle is moved to the coupled position; and a first latch arranged to latch the second component to the shuttle such that upon decoupling of the first and second components, the shuttle is returned to the decoupled position. The first latch ensures that when the first and second components are decoupled, and therefore disconnected, the shuttle is returned to the decoupled position in which it protects the first contact. The shuttle is returned to the decoupled position by the action of decoupling and without the need of a spring.

The first and second components may be coaxial, or concentric, with one another and therefore the connector may be referred to as a concentric connector. In order to couple the first and second components it may be necessary to axially align them. However, the first and second components may be capable of being coupled to one another regardless of their rotational orientation with respect to one another.

The first latch may be arranged to be automatically engaged upon coupling of the first and second components. For example, as the first and second components are coupled together, the act of coupling may engage the first latch so that the shuttle is latched to the second component. This would allow the shuttle to move with the second component. Similarly, the first latch may be arranged to be automatically disengaged upon decoupling of the first and second components. For example, as the first and second parts are decoupled from one another, the act of decoupling may disengage the first latch.

The connector may further comprise a second latch arranged to latch the shuttle to the first component in the decoupled position so as to retain the shuttle in the decoupled position when the first and second components are decoupled. This may prevent the shuttle from being completely withdrawn from the first component or may prevent the shuttle from moving away from the decoupled position when the first and second components are not coupled together. The second latch may be arranged to be automatically engaged upon decoupling of the first and second components. For example, as the first and second components are decoupled from one another, the act of decoupling may engage the second latch. The second latch may be arranged to be automatically disengaged upon coupling of the first and second components. For example, as the first and second components are coupled together, the act of coupling may disengage the second latch so that the shuttle is able to move with respect to the first component. This would allow the shuttle to move away from the decoupled position.

The force required to engage the first latch may be less than the force required to disengage the second latch, such that upon coupling of the first and second components the first latch is engaged before the second latch is disengaged. This may ensure that during coupling of the first and second components, the second component is latched to the shuttle before the shuttle is delatched from the first component. The force required to engage the second latch may be less than the force required to disengage the first latch, such that upon decoupling of the first and second components the second latch is engaged before the first latch is disengaged. This may ensure that during decoupling of the first and second components, the shuttle is latched to the first component before the second component is delatched from the shuttle.

The first latch may comprise corresponding first latching parts provided on the shuttle and the second component that are arranged to engage with one another. The corresponding first latching parts may be a first latch projection provided on the shuttle or the second part and a first latch recess provided on the other of the shuttle and the second part. One or both of the first latching parts may be resiliently deformable. The second latch may comprise corresponding second latching parts provided on the shuttle and the first component that are arranged to engage with one another. The corresponding second latching parts may be a second latching projection provided on the shuttle or the first component and a second latching recess provided on the other of the shuttle and the first component. One or both of the second latching parts may be resiliently deformable.

The shuttle may comprises one or more shuttle latching parts comprising a first latching part for latching to the first latching part of the second component and a second latching part for latching to the second latching part of the first component. The shuttle latching part may be resiliently deformable. The shuttle latching part may axially extend from a main wall of the shuttle. The shuttle latching part may be resiliently deformable in the radial direction. There may be a plurality of shuttle latching parts. The plurality of shuttle latching parts may be circumferentially arranged around the shuttle which may be annular.

The first and second components may each have an axial opening extending therethrough, such that when the first and second components are coupled, an axial opening extends through the connector. In such an arrangement an opening would extend entirely through each component and therefore entirely through the connector. The openings may be coaxial with one another when the components are coupled. The or each opening may be coaxial with the connector. This may allow conduits, such as production fluid tubing or electrical cables, to pass through the connector. This may allow production fluid to pass through the connector.

The first and second components may be substantially annular. The first and second components may be coaxial with one another. An inner diameter of one of the components may substantially correspond with an outer diameter of the other component such that one can be inserted into the other. The shuttle may be substantially annular. The shuttle may be coaxial with the first and/or second component. The outer or inner diameter of the shuttle may substantially correspond to an inner or outer diameter of the first component. The first component may comprise an axially extending annular channel, or recess, within which the shuttle is disposed and axially moveable between the decoupled position and the coupled position. The radial width of the annular channel may substantially correspond with the radial thickness of the shuttle. The annular channel may be arranged to receive a portion of the second component when the first and second components are coupled. For example, the second component may comprise an axially extending annular wall arranged to be received in the annular channel. The radial thickness of the annular wall may substantially correspond with the radial width of the annular channel.

The first contact and/or the second contact may be disposed on an inner surface or an outer surface and may be annular. For example, the first contact may be an annular contact band disposed on an inner, or outer, surface of the first component and the second contact may be a pad disposed on an outer, or inner, surface of the second component. This would allow the first and second components to be coupled at any rotational orientation to achieve a connection. Alternatively, the second contact could be an annular band and the first contact could be a pad, or both contacts could be annular bands. In one embodiment the first contact could be an annular band and there could be a plurality of second contact pads. The first contact may be provided on an inner surface (or on an outer surface) of the first component and the second contact may be provided on a corresponding outer surface (or on an inner surface) of the second component. The inner surface of the first component may be substantially cylindrical and the outer surface of the second component may be substantially cylindrical. The inner surface may be inwardly facing and may be at least partially concave and the outer surface may be outwardly facing and may be at least partially convex.

The shuttle may be a shuttle pin that in the decoupled position protects, or covers, the first contact. The first contact may be provided on an inner surface. The shuttle pin may have a substantially cylindrical outer surface. The first contact may be provided on an inner surface which is substantially cylindrical. The cylindrical outer surface of the shuttle pin may be disposed adjacent to the inner surface on which the first contact may be provided. The first contact may be an annular band provided on an inner surface. The shuttle pin may be solid or hollow, for example. The first component, with which the shuttle pin is associated, may be a female component arranged to receive a male contact pin.

The first component may further comprise a wiper seal arranged to wipe the second contact upon coupling and/or decoupling of the first and second components.

The first component may be a female component and the second component may be a male component.

The connector may be a wet-mateable connector. The connector may be an electrical and/or an optical connector.

The invention may comprise any combination of the features and/or limitations referred to herein, except combinations of such features as are mutually exclusive.

BRIEF DESCRIPTION OF THE DRAWINGS

Embodiments of the invention will now be described, by way of example only, with reference to the accompanying drawings, in which.

DESCRIPTION OF AN EMBODIMENT OF THE INVENTION

Figure 1:
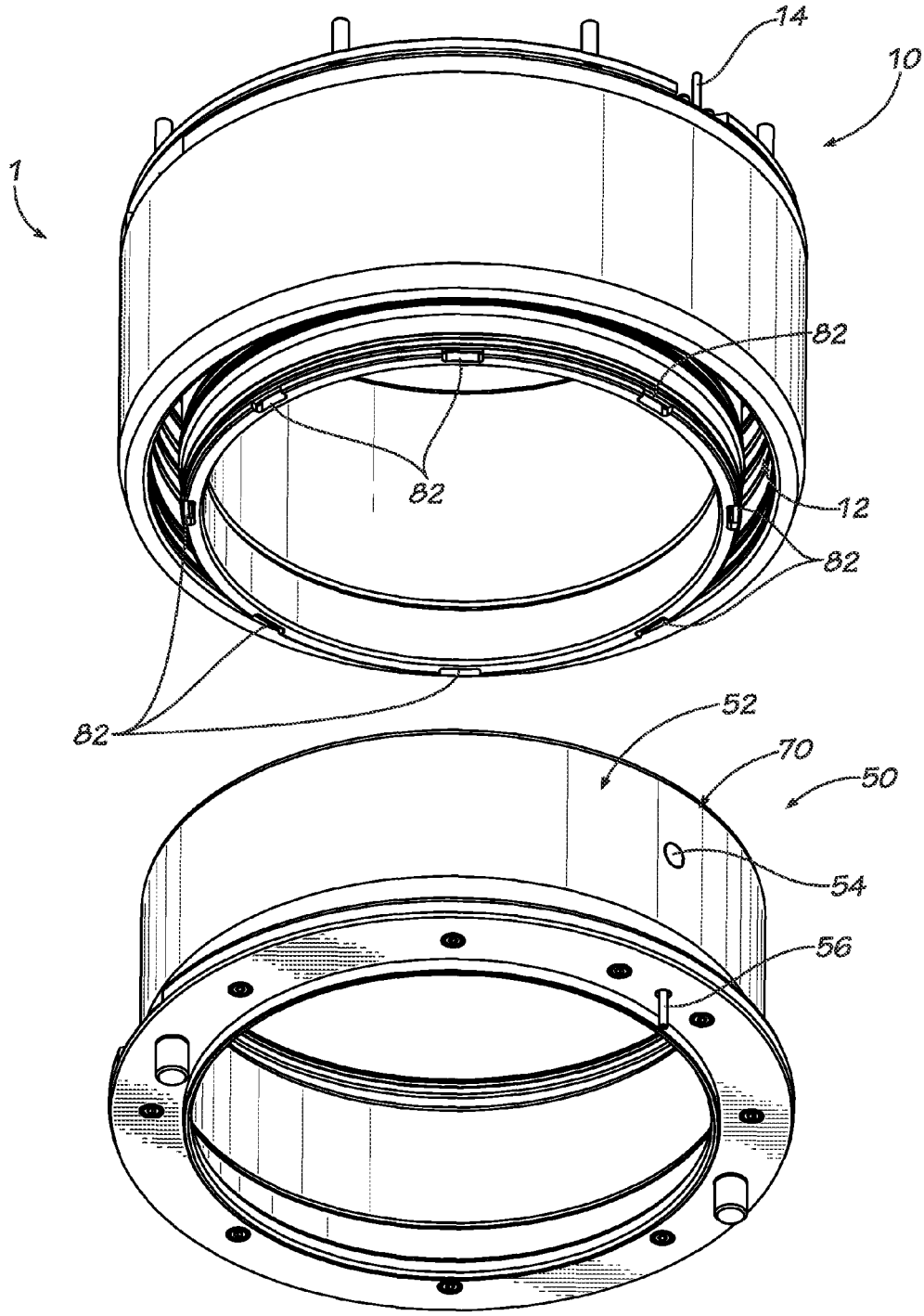
FIG. 1 schematically shows a perspective view of a connector comprising male and female components in a decoupled position.

FIG. 1 shows a connector 1 comprising a female (or first) component 10 and a male (or second) component 50 in a decoupled configuration. In this embodiment the female component 10 may be attached to a monitoring instrument (not shown) and the male component 50 may be attached to, or part of, the tubing hanger of an oil production well installation. The male component 50 may therefore be connected to downhole equipment. The female component 10 is generally annular and comprises an annular channel 12 having a female annular electrical contact band (not shown in FIG. 1) disposed on an inner annular surface. The contact band is electrically coupled to a connection cable 14 which may be connected to monitoring equipment. The male component 50 is also generally annular and comprises an annular wall 52 having a male electrical contact pad 54 disposed on an outer annular surface. The contact pad 54 is electrically coupled to a connection cable 56 which may be connected to downhole instruments or sensors. The female and male components 10, 50 are arranged to be coupled together so that an electrical connection is made between the contact band and the connection pad.

Figure 2:
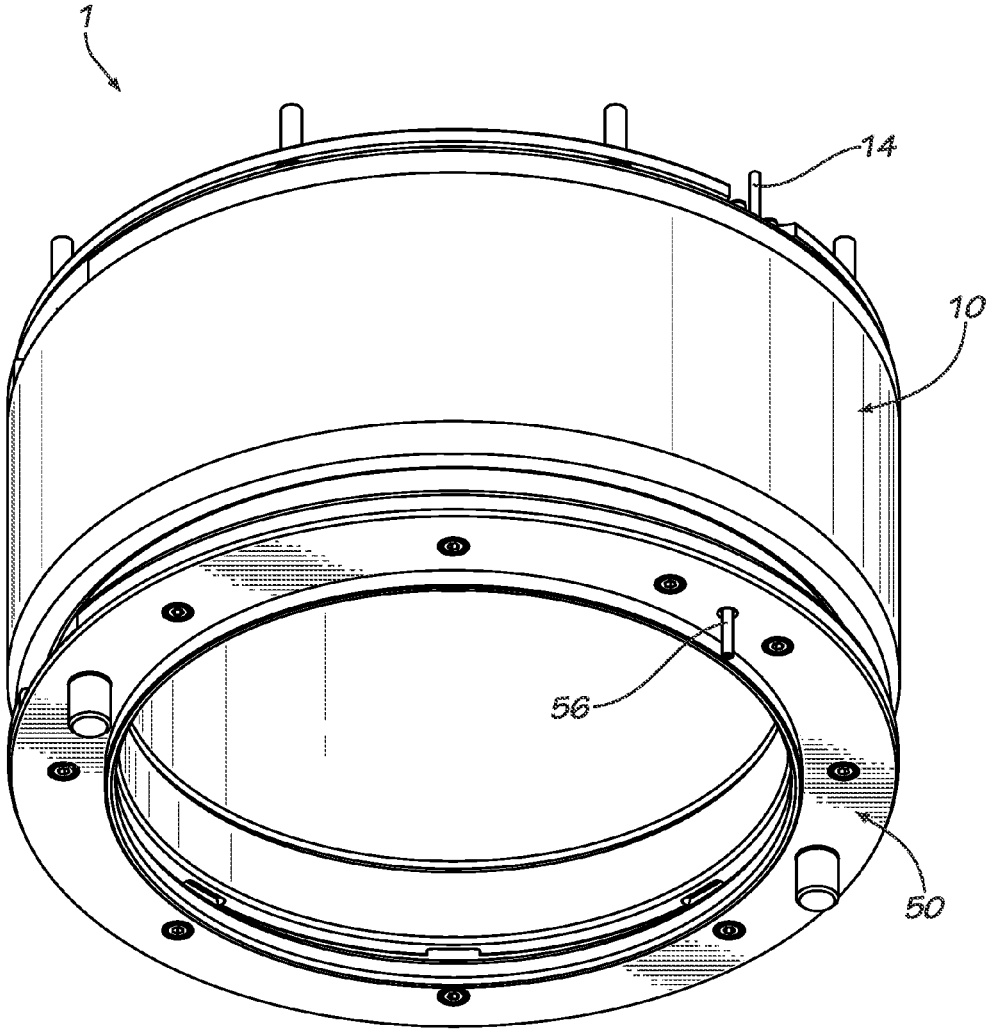
FIG. 2 schematically shows the connector of FIG. 1 with the male and female components coupled together.

With reference to FIG. 2, when the female and male components 10, 50 are fully mechanically coupled together, the annular wall 52 of the male component 50 is located within the annular channel 12 of the female component 10. In this arrangement the contact pad 54 of the male component 50 makes and maintains electrical contact with the contact band of the female component, thereby ensuring electrical continuity between the connection cables 14, 56. In order to mechanically couple the female and male components 10, 50, the components must be axially aligned and therefore when they are coupled together they are coaxial. However, because of the provision of an annular contact band on the female component 10, the female and male components 10, 50 can be electrically connected at any relative rotational orientation between the female and male components 10, 50.

Figure 3:
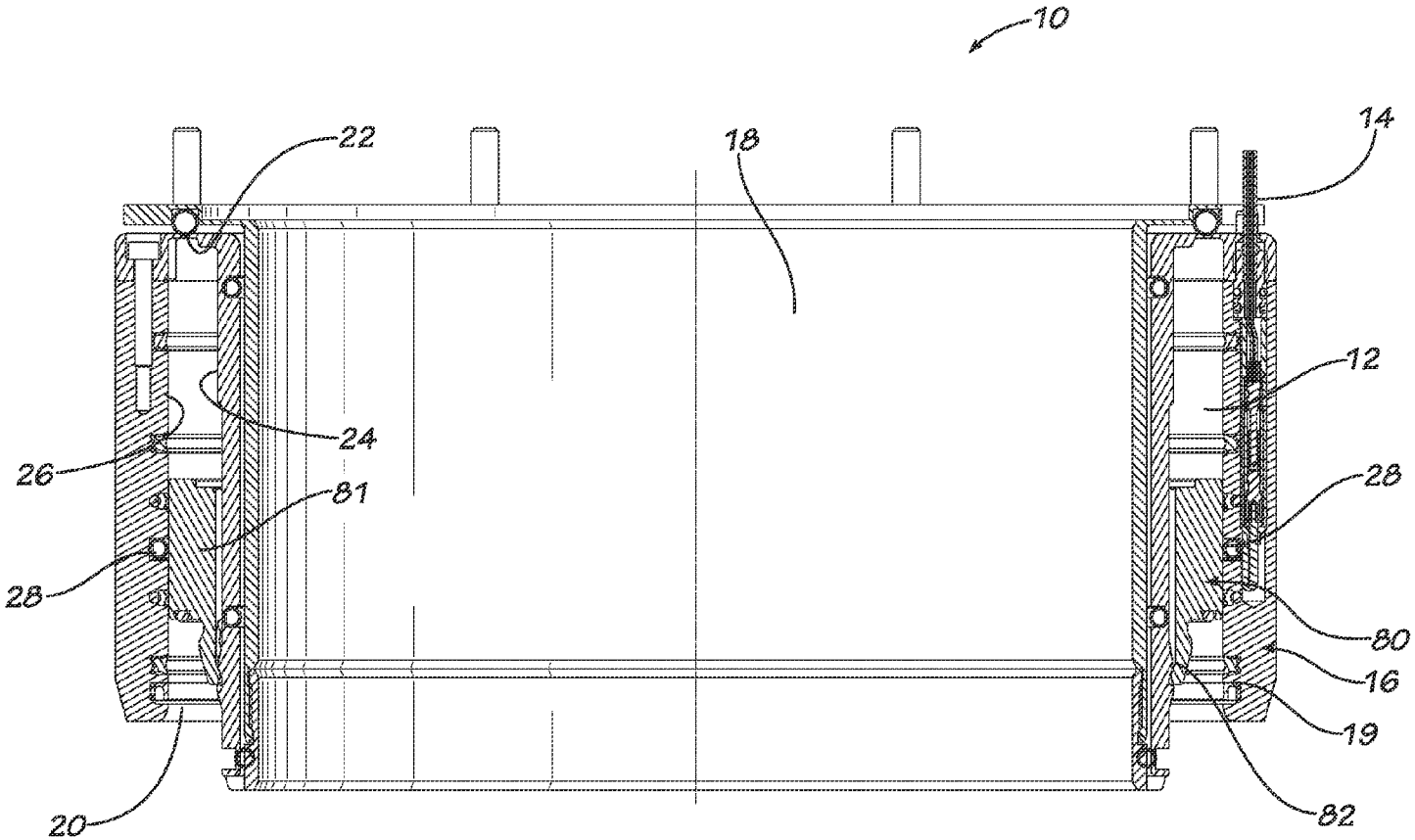
FIG. 3 schematically shows a cross-sectional view of the female component of FIG. 1.

As shown in FIG. 3, the female component 10 is generally annular and rotationally symmetrical. The female component comprises an annular female body 16 having a central opening 18 that extends through the female body 16. An annular channel 12 is formed in the female body 16 and is coaxial with the female body 16. The annular channel 12 is open at a lower end 20 and an upper end 22 and is defined by an outer generally cylindrical wall 24 and an inner generally cylindrical wall 26. A female annular electrical contact band 28 is disposed on the inner cylindrical wall 26 and is exposed along its entire circumference. The electrical contact band 28 is electrically connected to a connection cable 14 which extends outside of the female body 16. The female component 10 also comprises a wiper seal 19 that is disposed towards the lower end 20 of the channel 12 in a recess formed in the inner wall 26.

An annular protective shuttle 80 is associated with the female component 10 and is disposed within the annular channel 12. The shuttle 80 comprises a main annular wall 81 and a plurality of shuttle latching parts 82 that will be described in detail with reference to FIG. 5. The radial width of the channel 12 is slightly greater than the radial thickness of the shuttle main wall 81 which allows the shuttle 80 to fit within the channel 12. The shuttle 80 can axially slide within the channel 12 between at least a decoupled position (shown in FIG. 3) and a coupled position (shown in FIG. 9). In the decoupled position, when the female and male components 10, 50 are disconnected, the shuttle 80 is disposed in the region of the lower end 20 of the channel 12 and is positioned over the contact band 28 so that it protects the contact band 28 from coming into contact with contaminants. Such contaminants may damage the contact band 28 or may prevent successful electrical coupling with the contact pad 54. In the coupled position, when the female and male components 10, 50 are coupled, the shuttle 80 is located towards the top 22 of the channel 12 and the contact band 28 is exposed. This allows the contact pad 54 of the male component 50 to make an electrical connection with the contact band 28. As will be described in more detail below, the shuttle 80 is moved from the decoupled position to the coupled position by the action of coupling the female and male components 10, 50 and the shuttle 80 is returned to the decoupled position by the action of decoupling the female and male components 10, 50.

Figure 4:
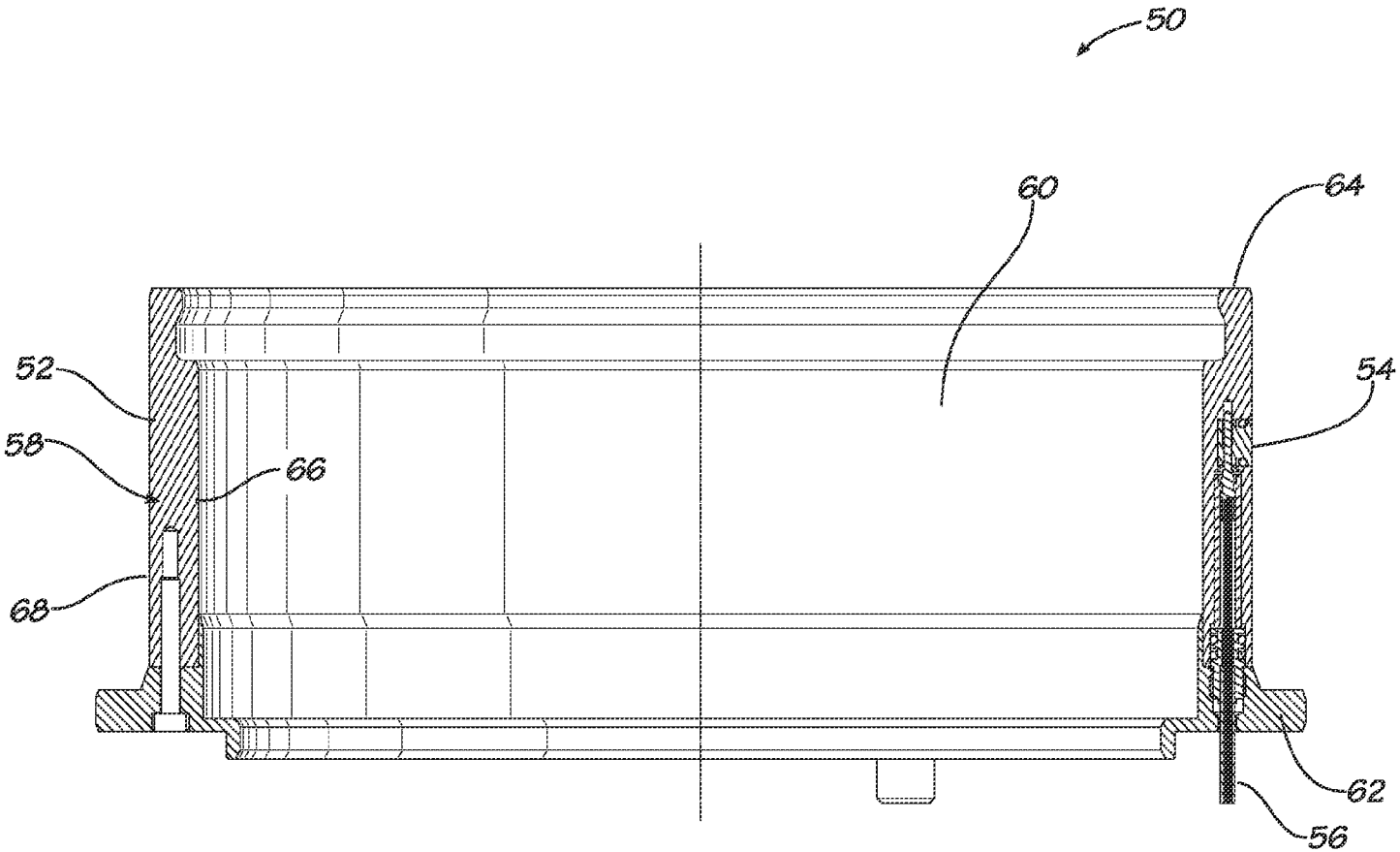
FIG. 4 schematically shows a cross-sectional view of the male component of FIG. 1.

As shown in FIG. 4, the male component 50 comprises a substantially annular male body 58 having a central opening 60 that extends through the body 58. The male body 58 has an axially extending annular wall 52 that extends from a base flange 62. The annular wall 52 comprises an upper end 64, an inner cylindrical surface 66 and an outer cylindrical surface 68. A male contact pad 54 is disposed on the outer cylindrical surface 68 and is electrically connected to a connection cable 56 that extends outside of the male body 58. The annular wall 52 of the male component 50 is arranged to be inserted into the annular channel 12 of the female component 10 so that the male contact pad 54 makes electrical connection with the female contact band 28. In order to allow the annular wall 52 to be inserted into the annular channel 12, the radial thickness of the wall 52 is slightly less than the radial width of the channel 12.

Figure 5:
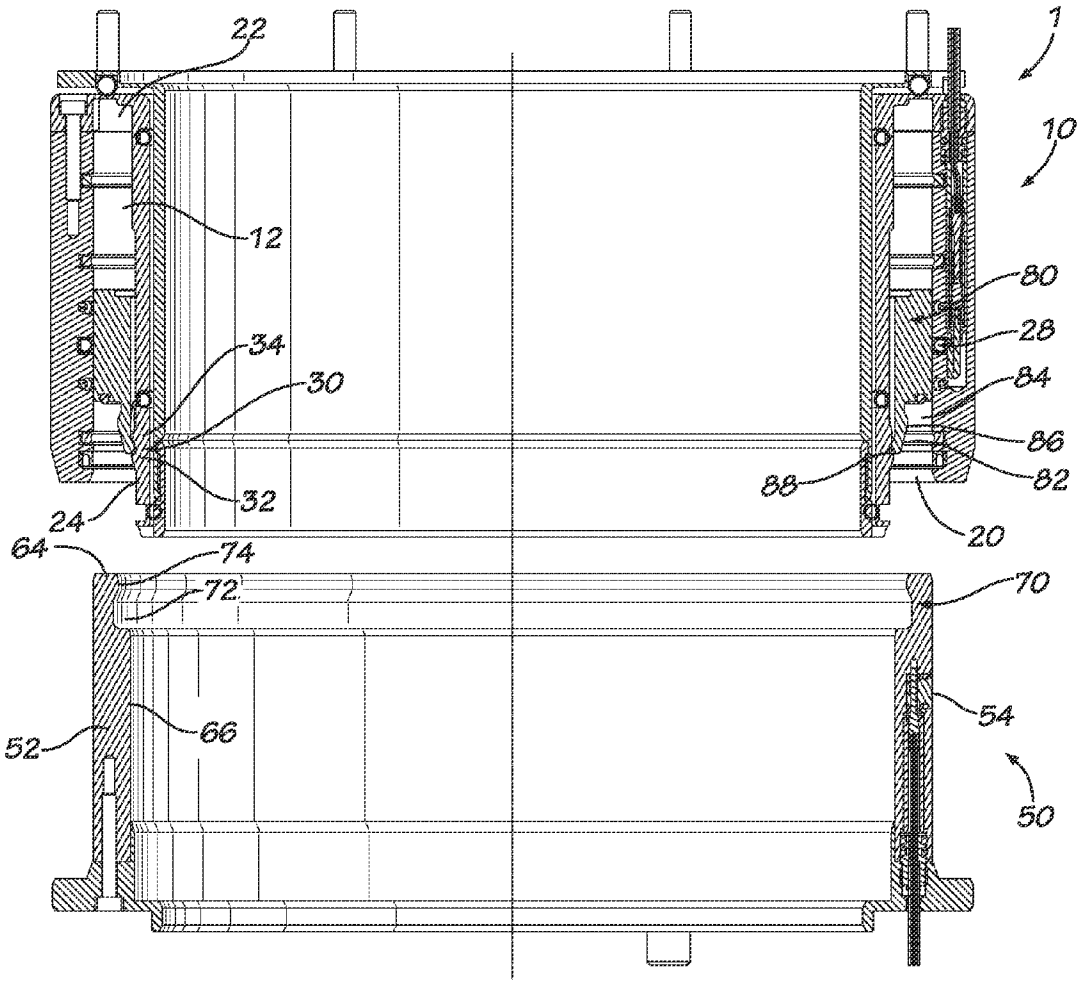
FIG. 5 schematically shows a cross-sectional view of the male and female components in a decoupled position.

With reference to FIG. 5, the connector 1 also comprises first and second latches. The first latch is arranged to latch the male component 50 to the shuttle 80 and the second latch is arranged to latch the shuttle 80 to the female component 10.

The first latch comprises a male latching part 70 and a plurality of shuttle latching parts (or tabs) 82. The male latching part 70 is provided towards the upper end 64 of the annular wall 52 of the male component 50 and is in the form of a profiled inner surface of the annular wall 52. The male latching part 70 comprises an annular recess 72 and an annular projection 74 that are formed on the inner surface 66 of the wall 52. A plurality of shuttle latching parts (or tabs) 82 substantially axially extend from the lower end of the shuttle 80 and are circumferentially spaced around the shuttle 80 (FIG. 1). In this embodiment there are twelve shuttle latching parts 82 that are circumferentially spaced around the circumference of the shuttle 80. Each shuttle latching part 82 has a profiled outer surface and comprises an outer radial recess 84 and an outer radial projection 86. Each of the shuttle latching parts 82 is also resiliently deformable in the radial direction. Upon coupling of the female and male components 10, 50 the plurality of shuttle latching parts 82 engage with the male latching part 70 so that the male component 50 is latched to the shuttle 80. Specifically, upon coupling, the shuttle latching parts 82 resiliently deform so that the outer projections 86 ride over the annular projection 74 formed on the inner surface 66 of the male component 50. When the shuttle 80 is latched to the male component 50 the outer radial projections 86 are located within the annular recess 72 of the male latching part 70 and the annular projection 74 of the male latching part 70 is located within the outer radial recesses 84. Upon decoupling, the reverse happens and the outer projections 86 ride over the annular projection 74 of the male latching part 70.

The second latch comprises a female latching part 30 and the plurality of shuttle latching parts 82. The female latching part 30 is provided towards the lower end of the outer wall 24 of the female component 10 and is in the form of a profiled outer surface of the outer wall 24. The female latching part 30 comprises an annular recess 32 and an annular projection 34 that are formed on the outer wall 24. In addition to the profiled outer surface of the shuttle latching parts 82, each shuttle latching part 82 has a lower edge 88 that projects radially inwardly and has a radius of curvature about the axis of the female component 50 that corresponds to that of the annular recess 32 of the female latching part 30. As described above, when the female and male components 10, 50 are in the decoupled configuration (shown in FIG. 5), the shuttle 80 is located in a decoupled position in which it is positioned over, and protects, the contact band 28. The shuttle 80 is retained in the decoupled position by the engagement of the shuttle latching parts 82 and the female latching part 30 that comprise the second latch. Specifically, in the decoupled position the lower edge 88 of each shuttle latching part 82 is located within, or engaged with, the annular recess 32 formed on the outer surface 24 of the female component 10. Upon coupling, the shuttle latching parts 82 of the shuttle 80 resiliently deform and the inwardly projecting lower edges 88 ride over the annular projection 34 so that they are no longer located within the annular recess 32. The second latch is thereby disengaged and the shuttle 80 can move towards the upper end 22 of the annular channel 12 and into the coupled position in which the contact band 28 is exposed. Upon decoupling, the reverse happens and the shuttle 80 moves axially towards the lower end 20 of the annular channel 12 and the edges 88 of the shuttle latching parts 82 resiliently bend outwardly and ride over the annular projection 34 and locate within the annular recess 32, thereby engaging the second latch.

When the second latch is engaged by the location of the inwardly projecting edges 88 of the shuttle latching parts 82 in the annular recess 32 of the female latching part, the shuttle 80 is retained in the decoupled position in which it protects the contact band 28. The shuttle 80 is inhibited from moving away from the decoupled position, for example to the coupled position, and the second latch also prevents the shuttle 80 from being withdrawn from the annular channel 12 of the female component 10.

The operation of coupling and decoupling the female and male components 10, 50 will now be described with reference to FIGS. 5-9.

FIG. 5 shows the female component 10 and the male component 50 in the non-coupled, or de-coupled, position in which there is no electrical contact between the female contact band 28 and the male contact pad 54. The shuttle 80 is located in the decoupled position in which it covers, or protects, the contact band 28 and the second latch is engaged so as to retain the shuttle 80 in this position.

Figure 6:
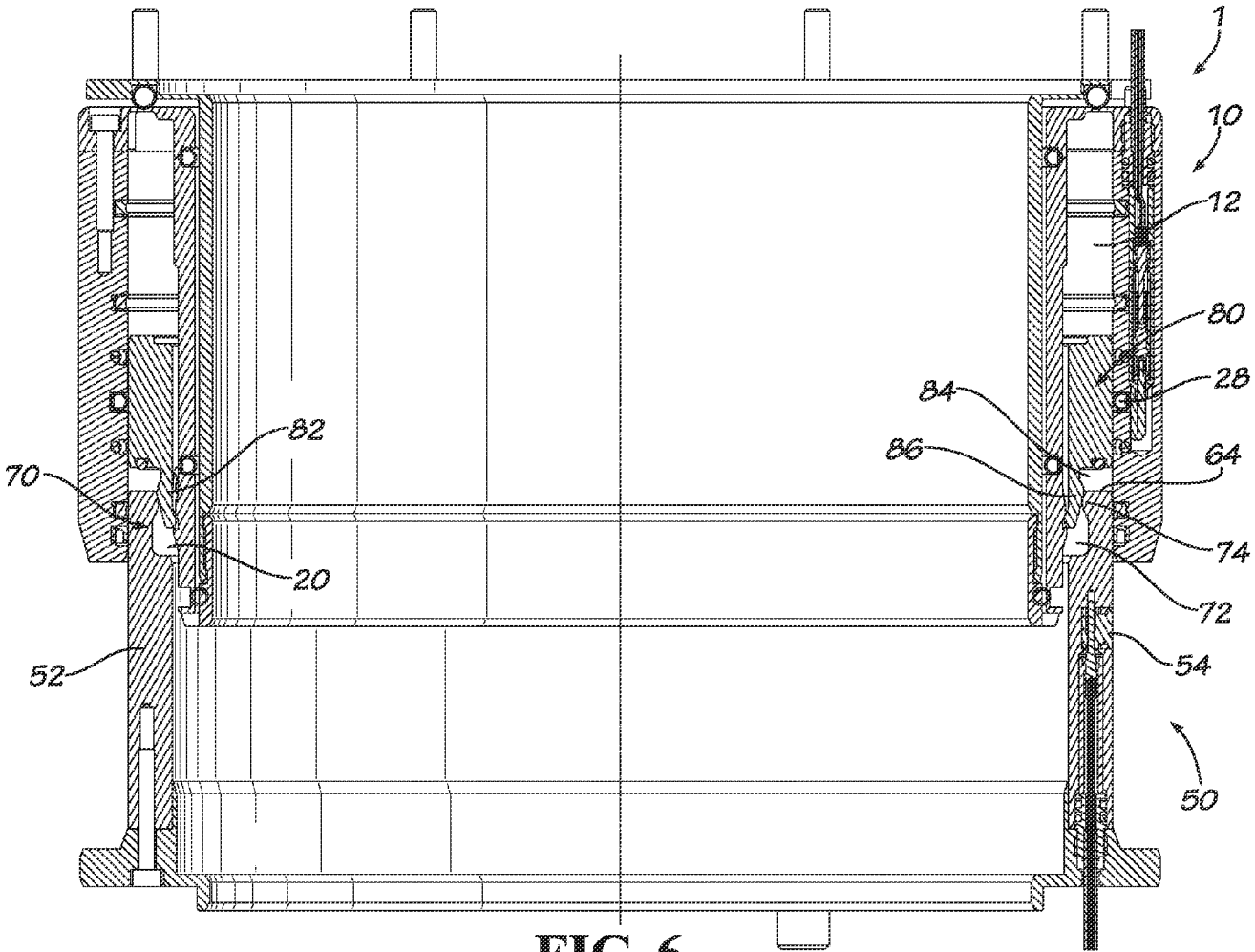
FIG. 6 schematically shows a cross-sectional view of the male and female components in contact.

As shown in FIG. 6, as coupling of the female component 10 and the male component 50 begins, the lower end 20 of the channel 12 of the female component 10 is located over the annular wall 52 of the male component 50. The upper end 64 of the annular wall 52 makes initial contact with the shuttle latching parts 82 of the shuttle 80 that is associated with the female component 10. More particularly, the inner surface of the annular projection 74 of the male latching part 70 makes contact with the outer radial projections 86 of the shuttle latching parts 82.

Figure 7:
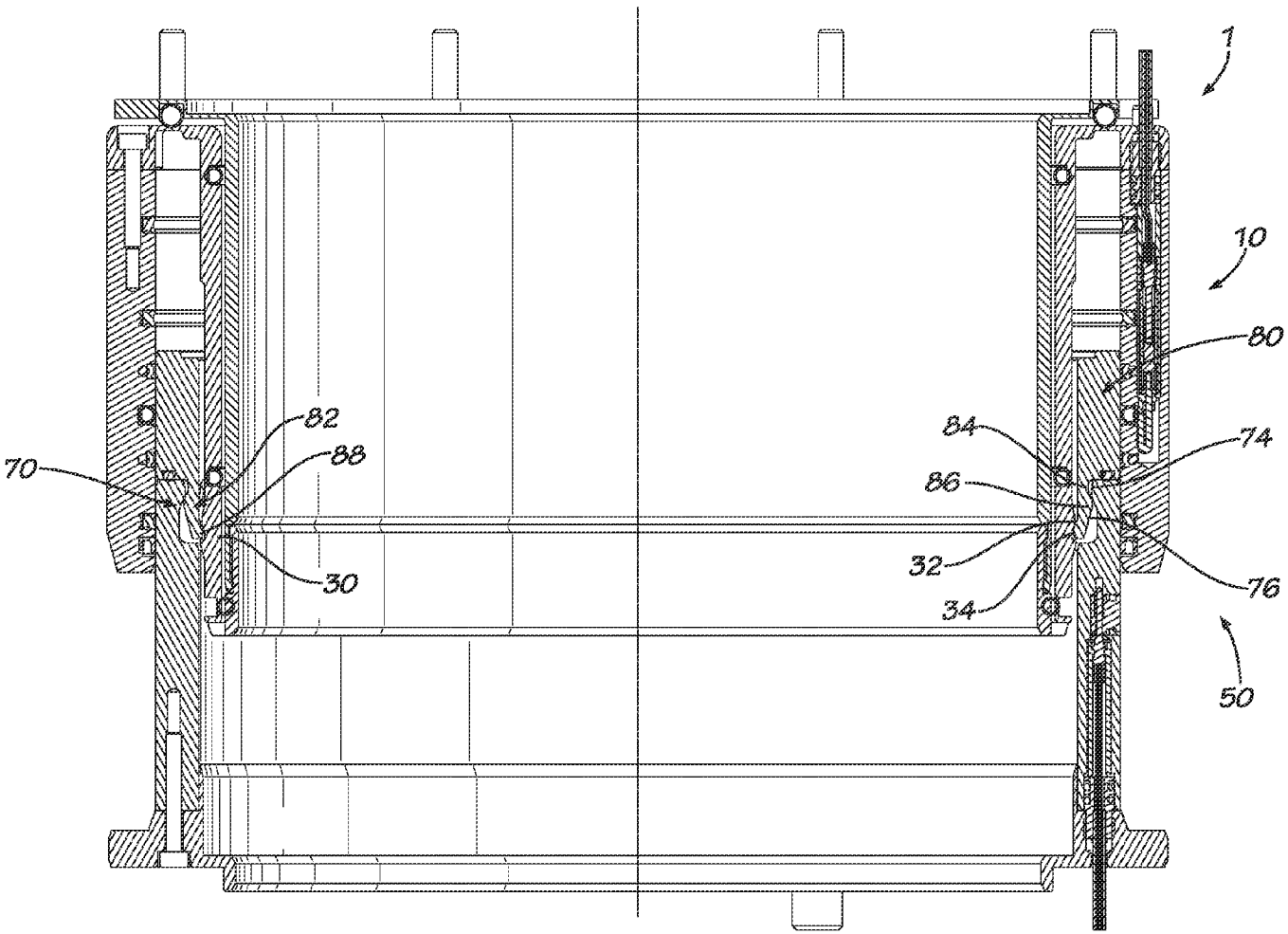
FIG. 7 schematically shows a cross-sectional view of the male and female components with the shuttle latched to the male and female components.

With reference to FIG. 7, as the female and male components 10, 50 are further coupled together by increasing the axially applied coupling force, the first latch between the male component 50 and the shuttle 80 is engaged. The annular projection 74 of the male latching part 70 causes each of the shuttle latching parts 82 to resiliently deform inwardly so that the radial outer projections 86 ride over the annular projection 74 and locate within the annular recess 72 of the male latching part 70. Similarly, the annular projection 74 locates within the radial outer recesses 84. In this manner the male latching part 70 is engaged with each of the shuttle latching parts 82 so that the male component 50 is coupled to the shuttle 80. As can be seen in FIG. 7, the first latch between the male component 50 and the shuttle 80 is engaged whilst the second latch between the shuttle 80 and the female component 10 is also still engaged.

Figure 8:
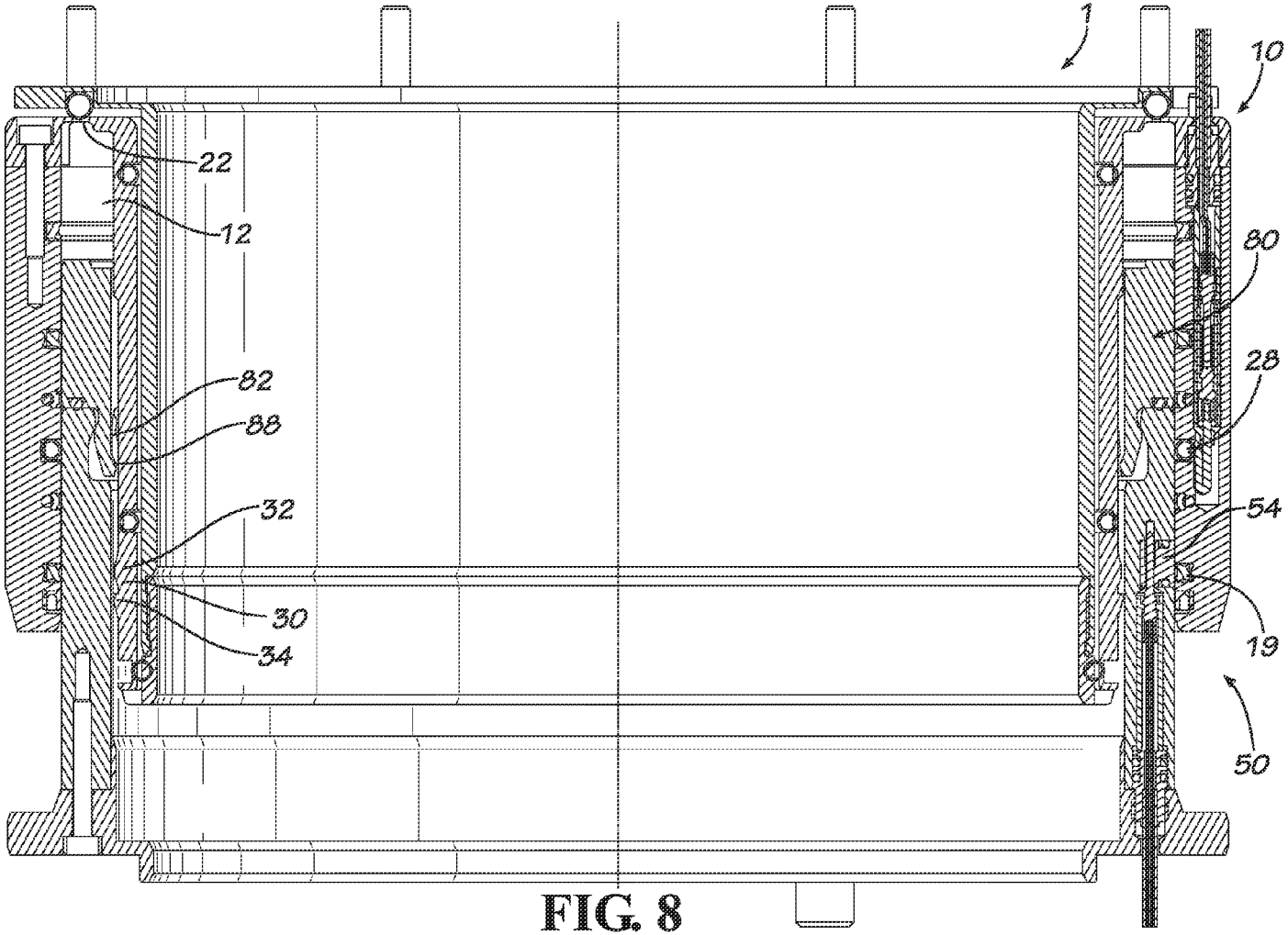
FIG. 8 schematically shows a cross-sectional view of the male and female components with the shuttle latched to the male component and delatched from the female component.

As shown in FIG. 8, as the female and male components 10, 50 are yet further coupled together by further increasing the axially applied coupling force, the second latch between the shuttle 80 and the female component 10 is disengaged. This allows the shuttle 80, coupled to the male component 50, to axially move within the annular channel 12 towards the upper end 22. As the axially applied coupling force between the female and male components 10, 50 increases, the shuttle latching parts 82 resiliently deform radially outwards and the inwardly projecting edges 88 ride over the annular projection 32 of the female latching part 30 so that they are no longer located within the annular recess 34 of the female latching part 30. In this manner the shuttle latching parts 82 are disengaged from the female latching part 30 so that the shuttle 80 can axially move relative to the female component 50 within the annular channel 12 away from the decoupled shuttle position. During coupling the male contact pad 54 slides past the wiper seal 19 which wipes the contact pad 54 in an attempt to remove any surface contaminants. As can be seen in FIG. 8, as the shuttle 80 is moved away from the decoupled position, the contact band 28 is exposed and is no longer protected by the shuttle 80.

The coupling force required to engage the first latch is less than the coupling force required to disengage the second latch. Therefore, upon coupling, the first latch between the male component 50 and the shuttle 80 is automatically engaged before the second latch between the shuttle 80 and the female component 10 is automatically disengaged. This ensures that the shuttle 80 does not start to move away from the decoupled position before it has latched to the male component 50.

Figure 9:
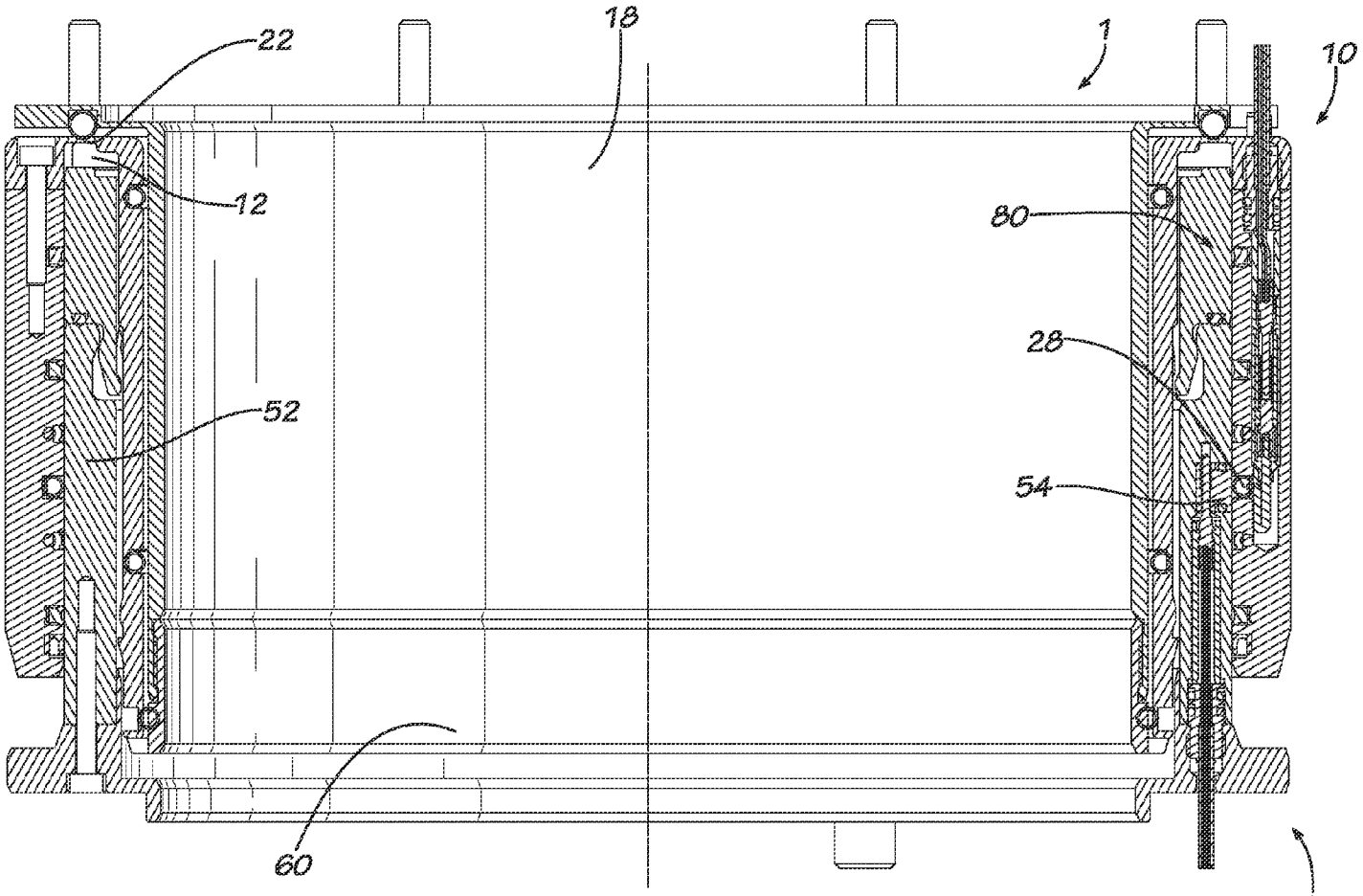
FIG. 9 schematically shows a cross-sectional view of the male and female components fully coupled.

Referring now to FIG. 9, as the female and male components 10, 50 are further coupled together the female component 10 is located further over the male component 50. Specifically, the annular wall 52 of the male component 50, which is latched to the shuttle 80, is moved within the annular channel 12 of the female component 10 until it reaches a stop. In this position, the shuttle 80 is located towards the upper end 22 of the annular channel 12 and is in the coupled position in which it does not cover and protect the annular contact band 28 and therefore the contact band 28 is exposed. In the fully coupled position shown in FIG. 9, the male contact pad 54 of the male component 50 is axially aligned with, and makes contact with, the annular contact band 28 of the female component 10. An electrical connection is thereby established between the female and male components 10, 50. When the female and male components 10, 50 are coupled together, the central openings 18, 60 are concentric with one another and therefore an opening through the connector 1 is provided. The opening through the connector 1 allows production fluid tubing to pass through the connector such that production fluid can flow through the connector.

Since the female component 10 is provided with a continuous annular contact band 28, the female and male components 10, 50 can be electrically coupled at any rotational orientation. This means that the female and male components 10, 50 do not have to be rotationally aligned for coupling. This also allows the female and male components 10, 50 to be rotated with respect to one another after coupling whilst maintaining an electrical connection. Although it has been described that the female component 10 comprises an annular contact band 28 and the male component 50 comprises a contact pad 54, in other embodiments both contacts could be annular bands, or the male contact could be an annular band and the female contact could be a pad, for example.

In order to decouple the female and male components 10, 50 the components are axially pulled apart by applying an axial decoupling force. The decoupling procedure is the reverse of the coupling procedure described above.

The male component 50 is axially withdrawn from the female component 10 by withdrawing the annular wall 52 of the male component 50 from the annular channel 12 of the female component 10. Since the first latch is engaged such that the shuttle 80 is latched to the male component 50, withdrawing the male component 50 from the female component 10 causes the shuttle 80 to axially move away from the coupled position towards the lower end 20 of the annular channel 12 (FIG. 8). As the male component 50 is further withdrawn from the female component 10, the shuttle 80 is moved towards the decoupled position towards the lower end 20 of the channel 12. As the shuttle 80 approaches the female latching part 30, the shuttle latching parts 82 resiliently deform outwards as they ride over the annular projection 32. The inwardly projecting edges 88 of the shuttle latching parts 82 then locate within the annular recess 34 such that the second latch between the shuttle latching parts 82 and the female latching part 30 is engaged (FIG. 7). At this point the second latch between the shuttle 80 and the female component 10 is engaged and the first latch between the shuttle 80 and the male component 50 is also engaged. As described above, when the second latch is engaged, the shuttle 80 is located in the decoupled position in which it protects the annular contact band 28. The shuttle 80 is prevented from being withdrawn from the annular channel 12 of the female component 10 by the engagement of the second latch. Further application of the axial decoupling force between the female and male components 10, 50 causes the first latch between the shuttle 80 and the male component 50 to disengage. Specifically, the shuttle latching parts 82 resiliently deform radially inwards so that the annular projection 74 of the male latching part 70 rides over the outer radial projections 86 of the shuttle latching parts 82. The annular projection 74 is therefore no longer located within the outer radial recesses 86 and the male latching part 70 is disengaged from the shuttle latching parts 82 (FIG. 6). Since the first latch between the male component 50 and the shuttle 80 is disengaged, the male component 50 can be completely withdrawn from the female component 10 (FIG. 5).

The decoupling force required to engage the second latch is less than the decoupling force required to disengage the first latch. Therefore, upon decoupling, the second latch between the shuttle 80 and the female component 10 is automatically engaged before the first latch between the shuttle 80 and the male component 50 is automatically disengaged. This ensures that the shuttle 80 is securely latched into the decoupled position before it is delatched from the male component 50.

The provision of the first latch between the male component 50 and the shuttle 80 ensures that when the male component 50 and the female component 10 are decoupled, the shuttle 80 is returned to the decoupled position in which is protects the annular contact band 28. The latch between the male component 50 and the shuttle 80 means that it is not necessary to provide a spring arrangement that resiliently biases the shuttle 80 to the decoupled position. This results in a less complicated design that is more reliable and compact.

The use of the second latch between the shuttle 80 and the female component 10 ensures that when the female component 10 and the male component 50 are not coupled together, the shuttle 80 is inhibited from moving away from the decoupled position. Further, the second latch also ensures that upon decoupling of the female and male components 10, 50 the shuttle 80 is not withdrawn from the female component.

Although it has been described that the shuttle 80 is associated with the female component 10 and that the first latch is arranged to latch the male component 50 to the shuttle 80, it should be noted that the shuttle 80 could be associated with the male component 50 and the first latch could be arranged to latch the female component 10 to the shuttle 80. In such an arrangement the shuttle 80 would be arranged to be moveable between a decoupled position in which it protects a contact provided on the male component 50 and a coupled position in which the contact is exposed such that a connection can be made with a contact provided on the female component.

Further, although it has been described that an opening extends through the connector 1, it should be appreciated that this is not essential. For example, the shuttle 80 could be a shuttle pin that in the decoupled position protects a first contact, provided on an inner surface, and which is moveable to a coupled position in which the first contact is exposed.

Although not described in the above embodiment, the shuttle 80 may be provided with one or more seals that are arranged to wipe the first contact, or a portion of the first contact, when moving between the decoupled position and the coupled position.

The invention claimed is:

1. A connector, comprising:

first and second components having first and second contacts respectively and arranged to be coupled together such that the first and second contacts make a connection;

a shuttle associated with the first component and moveable between at least a decoupled position in which the shuttle protects the first contact and a coupled position in which the first contact is exposed, wherein during coupling of the first and second components the shuttle is moved to the coupled position; and a first latch arranged to latch the second component to the shuttle such that upon decoupling of the first and second components, the shuttle is returned to the decoupled position.

2. A connector according to claim 1, wherein the first latch is arranged to be automatically engaged upon coupling of the first and second components.

3. A connector according to claim 1, wherein the first latch is arranged to be automatically disengaged upon decoupling of the first and second components.

4. A connector according to claim 1, further comprising a second latch arranged to latch the shuttle to the first component in the decoupled position so as to retain the shuttle in the decoupled position when the first and second components are decoupled.

5. A connector according to claim 4, wherein the second latch is arranged to be automatically engaged upon decoupling of the first and second components.

6. A connector according to claim 4, wherein the second latch is arranged to be automatically disengaged upon coupling of the first and second components.

7. A connector according to claim 4, wherein the force required to engage the first latch is less than the force required to disengage the second latch, such that upon coupling of the first and second components the first latch is engaged before the second latch is disengaged.

8. A connector according to claim 4, wherein the force required to engage the second latch is less than the force required to disengage the first latch, such that upon decoupling of the first and second components the second latch is engaged before the first latch is disengaged.

9. A connector according to claim 1, wherein the first latch comprises corresponding first latching parts provided on the shuttle and the second component that are arranged to engage with one another.

10. A connector according to claim 9, wherein at least one of the first latching parts is resiliently deformable.

11. A connector according to claim 1, wherein the second latch comprises corresponding second latching parts provided on the shuttle and the first component that are arranged to engage with one another.

12. A connector according to claim 11, wherein at least one of the second latching parts is resiliently deformable.

13. A connector according to claim 1, wherein the first and second components each have an axial opening extending therethrough, such that when the first and second components are coupled, an axial opening extends through the connector.

14. A connector according to claim 1, wherein the first and second components are substantially annular.

15. A connector according to claim 1, wherein the shuttle is substantially annular.

16. A connector according to claim 15, wherein the first component comprises an axially extending annular channel within which the shuttle is disposed and axially moveable between the decoupled position and the coupled position.

17. A connector according to claim 1, wherein the first contact and/or the second contact is annular.

18. A connector according to claim 1, wherein the first contact is provided on an inner surface of the first component and wherein the second contact is provided on a corresponding outer surface of the second component.

19. A connector according to claim 1, wherein the first component further comprises a wiper seal arranged to wipe the second contact upon coupling and/or decoupling of the first and second components.

20. A connector according to claim 1, wherein the first component is a female component and wherein the second component is a male component.

21. A connector according to claim 1, wherein the connector is a wet-mateable connector.

22. A connector according to claim 1, wherein the connector is an electrical and/or an optical connector.

23. An electrical connector, comprising:

a female component having a female electrical contact and an axial opening extending through the component;

a male component having a male electrical contact and an axial opening extending through the component;

wherein the female and male components are arranged to be coupled together so that the first and second contacts make an electrical connection and so that the axial openings are aligned thereby forming an axial opening through the connector through which production fluid tubing can pass;

a shuttle associated with the female component and moveable between at least a decoupled position in which the shuttle protects the female electrical contact and a coupled position in which the female electrical contact is exposed, wherein during coupling of the female and male components the shuttle is moved to the coupled position to expose the female electrical contact;

a first latch arranged to automatically latch the male component to the shuttle upon coupling so that upon decoupling of the female and male components, the shuttle is returned to the decoupled position; and a second latch arranged to automatically latch the shuttle to the female component in the decoupled position upon decoupling so as to retain the shuttle in the decoupled position when the female and male components are decoupled;

wherein the force required to engage the first latch is less than the force required to disengage the second latch, so that upon coupling of the first and second components the first latch is engaged before the second latch is disengaged; and wherein the force required to engage the second latch is less than the force required to disengage the first latch, such that upon decoupling of the first and second components the second latch is engaged before the first latch is disengaged.

* * * * *